US005507341A

United States Patent [19]

Eslinger et al.

[11] Patent Number: 5,507,341

[45] Date of Patent: Apr. 16, 1996

[54] INFLATABLE PACKER WITH BLADDER SHAPE CONTROL

[75] Inventors: David M. Eslinger, Tulsa, Okla.; L. Michael McKee, Alvin, Tex.; Robert M. Sorem, Lawrence, Kans.

[73] Assignee: Dowell, a division of Schlumberger Technology Corp., Sugar Land, Tex.

[21] Appl. No.: 362,630

[22] Filed: Dec. 22, 1994

[51] Int. Cl.[6] ..... E21B 33/127

[52] U.S. Cl. ..... 166/187; 166/195; 277/34

[58] Field of Search ..... 166/187, 120, 166/134; 277/34

[56] References Cited

U.S. PATENT DOCUMENTS

| | | | |
|---|---|---|---|
| 4,614,346 | 9/1986 | Ito | 277/34 |
| 4,892,144 | 1/1990 | Coone | 166/134 X |
| 5,048,605 | 9/1991 | Toon et al. | 166/187 |
| 5,205,567 | 4/1993 | Quinlan et al. | 277/34 |
| 5,280,824 | 1/1994 | Eslingen et al. | 166/187 |
| 5,327,962 | 7/1994 | Head | 166/187 |
| 5,327,963 | 7/1994 | Vance, Sr. et al. | 166/187 |
| 5,340,626 | 8/1994 | Head | 166/187 X |
| 5,353,871 | 10/1994 | Eslinger et al. | 166/187 |
| 5,417,289 | 5/1995 | Carisella . | |

*Primary Examiner*—Frank S. Tsay
*Attorney, Agent, or Firm*—John H. Bouchard

[57] ABSTRACT

An inflatable packer assembly used in well service work and having a mandrel that carries a normally retracted inflatable packer unit. The unit includes an inner elastomer bladder surrounded by a reinforcement. To control the shape of the unit during inflation and thereby prevent the formation of Z-folds in the bladder, its axial stiffness is preferentially increased relative to its circumferential or hoop stiffness by devices such as carbon fibers or fiberglass tape.

13 Claims, 1 Drawing Sheet

INFLATABLE PACKER WITH BLADDER SHAPE CONTROL

FIELD OF THE INVENTION

This invention relates generally to an inflatable packer that is used to isolate a well formation to enable it to be treated by fluid under pressure, and particularly to an inflatable packer having means to increase the longitudinal stiffness of the bladder unit to prevent Z-folding during inflation.

BACKGROUND OF THE INVENTION

An inflatable packer is a normally retracted device that is expanded into sealing engagement with a well conduit wall by pumping fluid under pressure into the interior of the packer unit. The packer unit comprises an inner elastomer bladder that is covered on its outside by a reinforcement such as an extrusion barrier for the bladder. When inflation pressure is relieved, the bladder and reinforcements retract toward their original size.

Unless the shape of the bladder is controlled during expansion, it can experience Z-folding, particularly when the packer has a high expansion ratio, which is the ratio being its fully expanded and fully retracted outer diameters. Generally an expansion ratio greater than 2:1 is considered to be high. Where the ratio is high, the bladder can initially inflate with a bubble so that it does not conform to the reinforcement. As a result, what can be called a Z-fold in the bladder is formed where a portion is folded back upon itself. Such folding causes high axial strains in the bladder and decreases the expanded thickness thereof. Generally, Z-folding occurs during inflation if the energy for the elastomer bladder to continue radial expansion is greater than the energy for the bladder to extend axially over an uninflated portion of the bladder. It has been found that bladders in slat-style packers are particularly susceptible to Z-folding problems under long lengths of exposed metal slats.

A general object of the present invention is to provide a new and improved inflatable packer having means to control bladder shape during inflation.

Another object of the present invention is to provide a new and improved inflatable packer including means to control bladder shape and thereby prevent severe folding of the bladder which can cause axial strains.

Still another object of the present invention is to provide a new and improved inflatable packer where the bladder unit has increased axial stiffness relative to its hoop or circumferential stiffness in order to control the shape thereof during expansion.

SUMMARY OF THE INVENTION

These and other objects are attained in accordance with the concepts of the present invention through the provision of an inflatable packer assembly including a central body or mandrel that carries an elongated annular packer unit whose opposite ends are attached and anchors to respective adapter heads on the mandrel. The packer unit includes an inner elastomer bladder that is surrounded and covered by a reinforcement which typically takes the form of circumferentially overlapped metal slats. In order to increase the longitudinal stiffness of the packer unit relative to its hoop stiffness, and thereby control the shape of the bladder during inflation and expansion, axially oriented fibers are incorporated into the elastomer bladder. In another embodiment, longitudinal strips of a relatively stiff material such as fiberglass tape are bonded to the exterior of the bladder. In still another embodiment, carbon fibers are bonded longitudinally on the outer surface of the bladder using an adhesive. In all cases the shape of the bladder is controlled to prevent the formation of Z-folds.

BRIEF DESCRIPTION OF THE DRAWINGS

The present invention has the above as well as other objects, features and advantages which will become more clearly apparent in connection with the following detailed description of preferred embodiments, taken in conjunction with the appended drawings in which.

DETAILED DESCRIPTION OF PREFERRED EMBODIMENTS

Figure 1:
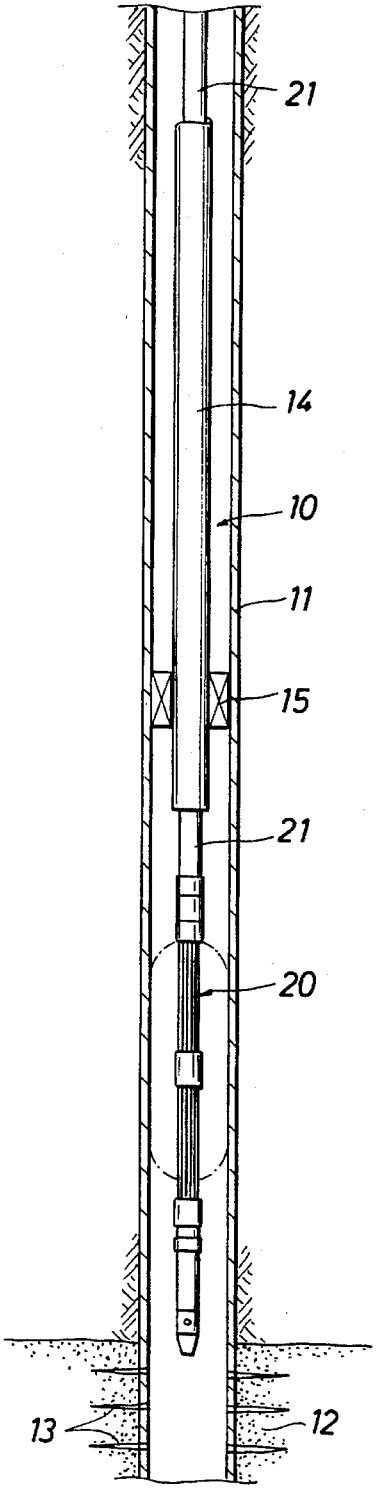
FIG. 1 is a schematic view of a well being treated using an inflatable packer.

Referring initially to FIG. 1, a well 10 that is lined with a casing 11 extends down through a formation 12 which is communicated with the casing bore by perforations 13. The production from the formation 12 flows to the surface through a production string 14 of tubing, and a packer 15 combines flow and pressure to the tubing. In order to treat the formation 12 with various chemicals or agents and remedy some production problem that has come un, a string of treating tools including an inflatable packer 20 is run through the production string 14 on coiled tubing 21. The coiled tubing 21 is injected into the production string 14 at the surface by a suitable unit (not shown) which has a storage reel, a guide, an injector assembly, pressure control equipment, and a pump for circulating well fluids under pressure down through the coiled tubing 21. The tool string in which the inflatable packer 20 is included has various components which are familiar to those skilled in this art and need not be discussed here. The inflatable packer 20 is designed to have a high ratio (greater than 2:1) between its expanded and retracted diameters for what can be called "through-tubing" service work. For example the normally retracted outer diameter of the packer 20 can be about 2 ⅛ inches in order to pass through a 2 ½ i.d. production string 14 and then be expanded to seal off against the casing 11 having an inner diameter of about 6 ½ inches. In this case the expansion ratio is approximately 3:1.

Figure 2:
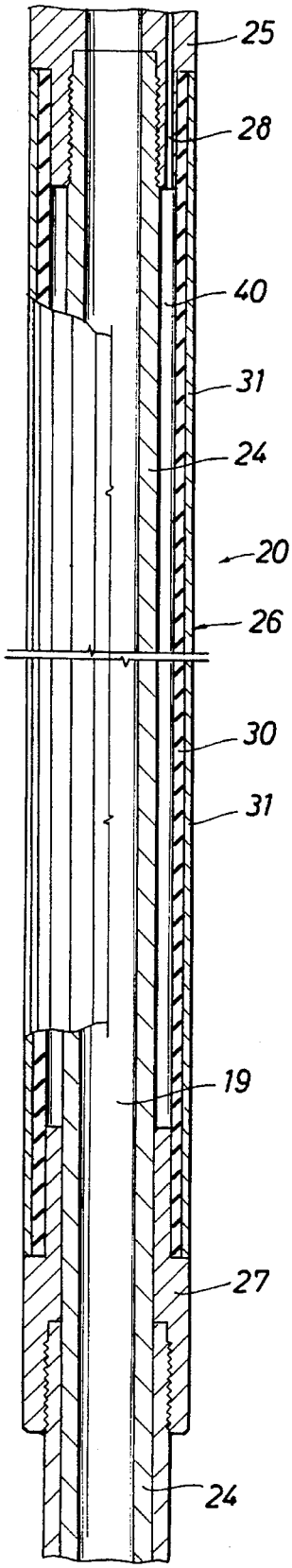
FIG. 2 is a longitudinal section view with some part in elevation, of an inflatable packer that includes the invention.

As shown in FIG. 2, the inflatable packer 20 includes a central tubular mandrel 24 that carries an upper adapter or head 25 to which the upper end of the packer unit 26 is anchored and sealed, and a lower adapter or head 27 to which the lower end of the unit 26 is anchored and sealed. In a typical arrangement, the lower head 27 can slide upward along the mandrel 24 and relatively toward the upper head 25 as the packer unit 26 is expanded. Fluid under pressure to inflate the unit 26 comes down through a passage 28 in the upper head 25 which is communicated via various other passages with the lower end of the coiled tubing 21. The central bore 19 of the mandrel 24 leads to a lower portion through which chemicals can be injected into the wellbore under pressure.

The principal components of the packer unit 26 are an inner elastomer sleeve or bladder 30 and a reinforcement which can take the form of circumferencially overlapped metal slats 31, although means such as stranded cables layed side-by-side could be used. The use of slats or cables is generally known. If desired, a relatively short and thin elastomer sheath (not shown in FIG. 2) can cover only a central portion of the slats 31. As the bladder 30 is expanded, the slats 31 progressively slide over one another and fan out from the ends toward the central portion of the bladder, but remain effective as an extrusion barrier that functions as the principal load bearing member when engaged with the casing wall.

Figure 3:
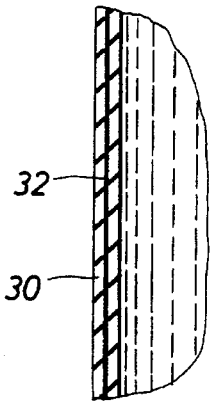
FIGS. 3–5 are enlarged, fragmentary views of portions of an elastomer bladder which has been axially stiffened in accordance with the invention.
Figure 4:
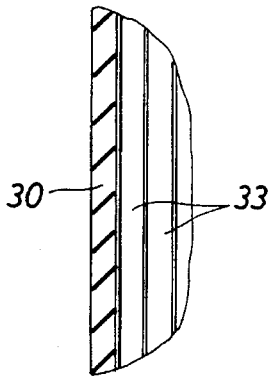
Figure 5:
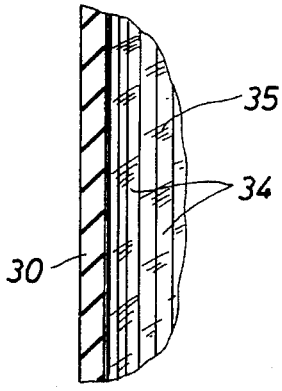

As noted above, Z-folding of the bladder 30 can occur when the energy for it to continue radial expansion is greater than the energy for the bladder to extend axially over an uninflated portion of the bladder. It has been found that slat-type packers are particularly susceptible to such folding when they have long lengths of exposed slats. To solve this problem, a means is provided to preferentially increase the axial stiffness, or tension modulus, of the bladder 30 relative to its stiffness in the circumferential or hoop direction. One embodiment of such means is shown in FIG. 3 when the elastomer bladder 30 is compounded with axially oriented fibers 32. The fibers 32 can be, for example, carbon fibers which extend through the center of the cross-section of the bladder 30. In another embodiment shown in FIG. 4, strips of fiberglass tape 33 are adhered to the outer wall of the bladder 30 in order to stiffen the same in the axial direction. In FIG. 5, still another embodiment is shown where carbon fibers 34 are layed on the outer surface of the bladder 30 and bonded thereto using a suitable adhesive 35. In each case the longitudinal stiffness of the packer unit is increased and the formation of Z-folds during expansion is eliminated.

OPERATION

In use and operation, the inflatable packer 20 is assembled as shown in the drawings and, together with associated tool string components, is run into the production string 14 on the lower end of the coiled tubing 21. The packer 20 emerges from the lower end of the production string 14 and is lowered until it is adjacent but above the perforations 13. Then the tool string is halted and the coiled tubing 21 manipulated to condition various components for a well pressuring operation, after which the surface mud pumps are started to inflate and expand the packer element 20.

Pressurized fluids pass into the interior 40 of the bladder 30 via the passage 28 in the upper head 23 and apply pressure forces in all axial and outward directions thereon so that the bladder is expanded outward as shown in dash lines in FIG. 1. The presence of one of the stiffener means shown in FIGS. 3, 4 or 5 preferentially increase the axial stiffness or section modulus of the bladder 30 relative to its hoop stiffness, which controls the shape of the bladder during inflation. The result is to eliminate Z-folding of the bladder 30 and the consequent high axial strain and decreased expanded thickness of the bladder caused thereby.

To retrieve the tool string from the well 10, the inflation pressure is relieved and the packer unit 26 will inherently retract toward its original diameter on account of the resilience of the bladder 30 and (he slats 31. Then the coiled tubing 21 and the tool string can be pulled up through the production tubing 14 to the surface as the coiled tubing is wound back onto its reel. If desired, the packer 20 can be reinflated several times where other service work needs to be done on the same trip, at the same or other downhole locations.

It now will be recognized that a new and improved inflatable packer has been disclosed having means to preferentially increase the tensile modulus of the bladder to control the inflation shape thereof. Since certain changes or modifications may be made in the disclosed embodiment without departing from the inventive concepts involved, it is the aim of the appended claims to cover all such changes and modifications falling within the true spirit and scope of the present invention.

What is claimed is:

1. An inflatable packer assembly, comprising:

normally retracted inflatable packer means adapted to be expanded by pressurized fluid into sealing engagement with a surrounding well conduit wall, said packer means including an elongated inner elastomer bladder having a shape and adapted to inflate in response to said pressurized fluid and adapted to expand during the inflation and reinforcement means around said bladder, said bladder including means for preferentially increasing a longitudinal stiffness of said bladder thereby controlling said shape during the expansion of said bladder.

2. The packer assembly of claim 1, wherein said means for increasing said longitudinal stiffness includes axially oriented fibers incorporated within said bladder.

3. The packer assembly of claim 1, wherein said means for increasing said longitudinal stiffness includes axially oriented fibers bonded to the exterior surfaces of said bladder.

4. The packer assembly of either claim 2 or claim 3 where said axially oriented fibers include carbon.

5. The packer assembly of claim 1 wherein said means for increasing said longitudinal stiffness includes axially arranged strips of stiff tape bonded to exterior surfaces of said bladder.

6. The packer assembly of claim 5 wherein said tape includes fiberglass.

7. The inflatable packer assembly of claim 1, wherein said means for preferentially increasing the longitudinal stiffness of said bladder increases said longitudinal stiffness of said bladder relative to a hoop stiffness of said bladder during expansion of said bladder.

8. An inflatable packer assembly, comprising: a mandrel; normally retracted inflatable packer means on said mandrel adapted to be expanded by pressurized fluid into sealing engagement with a surrounding well conduit wall; said packer means having an upper end anchored to an upper head on said mandrel and a lower end anchored to a lower head on said mandrel, at least one of said heads being movable relatively toward the other during inflation and expansion of said packer means; said packer means including an elongated inner elastomer bladder and reinforcement means covering the outer surfaces thereof; and means for preferentially increasing the axial stiffness of said bladder relative to the circumferential stiffness of said bladder thereby controlling the shape of said bladder during inflation of said bladder.

9. The packer assembly of claim 8, wherein said means for increasing the axial stiffness of said bladder includes a plurality of fibers axially arranged within the body of said bladder.

10. The packer assembly of claim 8, wherein said means for increasing the axial stiffness of said bladder includes axially extending continuous fibers bonded to exterior surfaces of said bladder.

11. The packer assembly of claim 9 or claim 10 wherein said fibers are carbon.

12. The packer assembly of claim 8 wherein said means for increasing the axial stiffness of said bladder includes axially arranged parallel strips of stiff tape bonded to exterior surfaces of said bladder

13. The packer assembly of claim 12 wherein said tape is made of fiberglass.

* * * * *